US005702021A

United States Patent [19]

Ito

[11] Patent Number: 5,702,021

[45] Date of Patent: Dec. 30, 1997

[54] LOCKING CONSTRUCTION OF ELECTRIC CONNECTION BOX

[75] Inventor: Hirokazu Ito, Yokkaichi, Japan

[73] Assignee: Sumitomo Wiring Systems, Ltd., Yakkaichi, Japan

[21] Appl. No.: 512,830

[22] Filed: Aug. 9, 1995

[30] Foreign Application Priority Data

Oct. 26, 1994 [JP] Japan ..... 6-262713
Oct. 28, 1994 [JP] Japan ..... 6-265688

[51] Int. Cl.[6] ..... B65D 43/02; B65D 45/16; B65D 45/18

[52] U.S. Cl. ..... 220/326; 220/284; 220/324; 220/780

[58] Field of Search ..... 220/326, 306, 220/234, 352, 353, 323, 324, 315, 284, 285; 292/89, 80, 107

[56] References Cited

U.S. PATENT DOCUMENTS

| | | | |
|---|---|---|---|
| 2,600,311 | 6/1952 | McSweeney | 292/80 X |
| 3,685,684 | 8/1972 | Schindler et al. | 220/324 |
| 4,212,415 | 7/1980 | Neely | 220/324 X |
| 4,336,961 | 6/1982 | Harris . | |
| 4,366,915 | 1/1983 | Seidler | 220/306 X |
| 4,469,225 | 9/1984 | Takahashi | 220/326 X |
| 4,688,692 | 8/1987 | Humbs et al. | 220/315 X |
| 5,326,275 | 7/1994 | Murakami . | |
| 5,348,356 | 9/1994 | Moulton | 292/80 |
| 5,394,902 | 3/1995 | Shibao | 220/324 X |

FOREIGN PATENT DOCUMENTS

| | | |
|---|---|---|
| 4-24624 | 6/1994 | Japan . . |
| 0948234 | 1/1964 | United Kingdom . |

*Primary Examiner*—Allan N. Shoap
*Assistant Examiner*—Niki M. Kopsidas
*Attorney, Agent, or Firm*—Greenblum & Bernstein P.L.C.

[57] ABSTRACT

A locking construction of an electric connection box having an upper casing and a lower casing, comprising: a locking claw which is provided on an outer surface of a first side wall of one of the upper and lower casings; an engageable portion which is provided on an inner surface of a second side wall of the other of the upper and lower casings such that the locking claw is brought into engagement with the engageable portion in a direction for fitting the first side wall into the second side wall; an L-shaped projection which is provided on the outer surface of the first side wall in the vicinity of the locking claw and includes a base portion and a bent portion; and a groove which is formed on an open end of the second side wall such that the base portion of the projection is inserted into the groove in the direction for fitting the first side wall into the second side wall; wherein when the base portion of the projection has been inserted into the groove, the second side wall is gripped between the bent portion of the projection and the first side wall.

6 Claims, 6 Drawing Sheets

LOCKING CONSTRUCTION OF ELECTRIC CONNECTION BOX

BACKGROUND OF THE INVENTION

1. Field of the Invention

The present invention relates to a locking construction of an electric connection box and more particularly, to a locking construction of an electric connection box which prevents an upper casing and a lower casing from being unlocked easily from each other. Further, the present invention relates to a locking construction of an electric connection box which allows locking members to be reliably locked to each other, thus preventing the upper or the lower casing provided with a connector installing portion from being moved upward or the connector installing portion from being broken or cracked when a pulling force is applied to the upper casing or the lower casing by a wiring harness connected with a connector.

2. Description of the Prior Art

An electric connection box is used to branch-connect a wiring harness for use in a motor vehicle to various electrical parts at one spot reasonably and economically by concentrating branch connection points. Various types of electric connection boxes have been developed for types and applications of motor vehicles in accordance with higher density of the wiring harness.

An example of an electric connection box is described below with reference to FIG. 6. In this electric connection box, in order to lock an upper casing 1 and a lower casing 2 to each other, a side wall 1*a* of the upper casing 1 is fitted into a side wall 2*a* of the lower casing 2 to bring a locking claw 1*b* of the side wall 1*a* of the upper casing 1 into engagement with an engageable portion 2*b* of the side wall 2*a* of the lower casing 2. The number of the locking claws 1*b* and that of the engageable portions 2*b* are about 10, respectively.

In the locking construction of the upper casing 1 and the lower casing 2, the engageable portion 2*b* is disengaged from the locking claw 1*b* when the side wall 2*a* of the lower casing 2 is deflected outward on purpose. As a result, the upper casing 1 can be removed from the lower casing 2.

Thus, if a user, etc. remove the upper casing 1 from the lower casing 2 and touches an internal circuit inadvertently, there is a possibility that a short circuit takes place.

In order to solve this problem, according to a conventional art, the upper casing 1 is welded to the lower casing 2 at a welding portion a so as to prevent the upper casing 1 from being removed from the lower casing 1 even in an unlocking state in which the locking claws 1*b* is disengaged from the engageable portion 2*b*.

If the upper casing 1 is welded to the lower casing 2, there are disadvantages that the upper casing 1 cannot be removed from the lower casing 2 during maintenance of the electric connection box at a maker or a dealer and that the electric connection box is expensive because it is necessary to perform the welding process additionally.

Conventionally, various electric connection boxes have been proposed which have a connector installing portion formed on an outer surface of a side wall of a casing so as to removably install a connector thereon. For example, as shown in FIG. 7A, in a connector installing construction disclosed in Examined Japanese Utility Model Publication No. 4-24624, a connector installing portion 1*c* comprising two opposed L-shaped cross-sectional portions is projected from a side wall 1*a* of an upper casing 1, and an engageable portion 3*b* which engages with the connector installing portion 1*c* from above is projected from an outer wall 3*a* of a connector 3.

In this connector installing construction, when a pulling force P is applied to the connector 3 by a wiring harness connected with the connector 3 as shown in FIG. 7A, the side wall 1*a* of the upper casing 1 is also pulled and the upper casing 1 is moved upward. As a result, there is a possibility that a corner 1*e* between the side wall 1*a* of the upper casing 1 and an upper wall 1*d* thereof is damaged.

In order to prevent the side wall 1*a* of the upper casing 1 from being pulled by the wiring harness, a connector installing portion 2*c* which has the same configuration as that of the connector installing portion 1*c* of the upper casing 1 and is continuous therewith is projected from a side wall 2*a* of a lower casing 2 so as to bring the engaging portion 3*b* of the connector 3 into engagement with the connector installing portions 1*c* and 2*c*.

Referring to FIG. 7B, another locking construction is proposed. In this construction, a projection 2*d* for retaining a lower end of the connector installing portion 1*c* of the upper casing 1 is formed on the side wall 2*a* of the lower casing 2.

In the conventional locking constructions shown in FIGS. 7A and 7B, the connector installing portion 1*c* of the upper casing 1, the connector installing portion 2*c* of the lower casing 2, and the projection 2*d* of the lower casing 2 are projected outward from the side wall 1*a* or the side wall 2*a*. Thus, when the upper and lower casings are molded or assembled with each other or when the upper casing is pulled by the wiring harness, there is a high possibility that the connector installing portion is fractured, cracked or chipped.

Further, in order to increase strength of connector installing portions 1*c* and 2*c* and that of the projection 2*d* when the upper and lower casings are molded or assembled with each other or when the upper casing is pulled by the wiring harness, it is necessary to increase the size or the thickness.

SUMMARY OF THE INVENTION

The present invention has been developed with a view to solving the above described disadvantages and has for a first object to provide a locking construction of an electric connection box which prevents an upper casing and a lower casing from being easily unlocked from each other without welding upper and lower casings to each other.

It is a second object of the present invention to provide a locking construction of an electric connection box which prevents a connector installing portion installed thereon from being readily fractured and which allows the connector installing portion to have a high strength without increasing the size.

In order to achieve the aforementioned objects, a locking construction of an electric connection box having an upper casing and a lower casing, according to the present invention comprises: a locking construction of an electric connection box having an upper casing and a lower casing, comprising: a locking claw which is provided on an outer surface of a first side wall of one of the upper and lower casings; an engageable portion which is provided on an inner surface of a second side wall of the other of the upper and lower casings such that the locking claw is brought into engagement with the engageable portion in a direction for fitting the first side wall into the second side wall; an L-shaped projection which is provided on the outer surface of the first side wall in the vicinity of the locking claw and includes a base portion and a bent portion; and a groove which is formed on an open end of the second side wall such that the base portion of the projection is inserted into the groove in the direction for fitting the first side wall into the second side wall; wherein when the base portion of the projection has been inserted into the groove, the second side wall is gripped between the bent portion of the projection and the first side wall.

A pair of the projections are, respectively, provided at opposite sides of the locking claw and a pair of the grooves are, respectively, provided at opposite sides of the engageable portion.

A connector installing portion for mounting a connection thereon is provided at a location on an outer surface of the second side wall corresponding to that of the engageable portion.

The bent portion of the projection is oriented in a direction towards or away from the locking claw.

In this locking construction, when the projection provided on the outer surface of the first side wall is inserted, in the direction for fitting the first side wall into the second side wall, into the groove formed on the open end of the second side wall in the vicinity of the locking claw and the engageable portion provided on the first and second side walls, respectively, the second side wall is gripped between the bent portion and the first side wall. Therefore, even if a user, etc. try to deflect the second side wall outwardly so as to disengage the locking claw from the engageable portion, the second side wall is held by the bent portion of the projection in the vicinity of the engageable portion and thus, is least likely to be deflected outwardly. Therefore, it is impossible to easily unlock the locking claw from the engageable portion.

Meanwhile, if a pair of the projections are, respectively, provided at the opposite sides of the locking claw and a pair of the grooves are, respectively, provided at the opposite sides of the engageable portion, deformation of the second side wall can be restrained uniformly at the projections.

Furthermore, if the connector installing portion for mounting the connector thereon is provided at the location on the outer surface of the second side wall corresponding to that of the engageable portion, the second side wall is positively retained by the projections. Thus, even if the connector attached to the connector installing portion is pulled, the second side wall is not moved upwardly.

Moreover, the present invention provides a locking construction of an electric connection box including an upper casing and a lower casing, comprising: a projection which is integrally provided on an outer surface of a first side wall of one of the upper and lower casings and includes a connection portion extending from the first side wall, a base portion extending from one end of the connection portion upwardly or downwardly and a bent portion extending from an outer side of the connection portion upwardly or downwardly such that an L-shaped portion is formed by the base portion and the bent portion; and a groove which is formed on an open end of a second side wall of the other of the upper and lower casings and includes a deep groove portion and a shallow groove portion formed in a stepped shape continuously such that the first side wall is fitted into the second side wall; wherein the base portion and the connection portion of the projection are, respectively, inserted into the deep groove portion and the shallow groove portion of the groove such that the second side wall is gripped between the bent portion of the projection and the first side wall.

When a connector installing portion for mounting a connector thereon is provided on an outer surface of the second side wall, a pair of the grooves are, respectively, provided at opposite sides of the connector installing portion so as to receive a pair of the projections, respectively.

The bent portion of the projection may also be formed so as to extend in a direction towards or away from the connector installing portion.

If the connector installing portion is provided on the lower casing and the projection is provided on the upper casing, the connector portion acts an upper wall portion connecting upper surfaces of the base portion and the bent portion. On the contrary, if the connector installing portion is provided on the upper casing and the projection is provided on the lower casing, the connector portion acts as a lower wall portion connecting lower surfaces of the base portion and the bent portion.

When the projection provided on the first side wall of one casing is inserted, in the direction for fitting the one casing into the other casing, into the groove provided on the second side wall of the other casing, the bent portion of the projection is brought into contact with the outer surface of the second side wall. Therefore, even if a pulling force is applied to the connector attached to the connector installing portion, the second side wall having the connector installing portion is not pulled so as to be moved upwardly and thus, is not damaged.

Furthermore, since the reinforcing connector portion is provided at an upper end or a lower end of the projection so as to extend over the base portion and the bent portion, strength of the projection can be raised without increasing its size or its thickness. In addition, the projection is least likely to be fractured, cracked or chipped.

Meanwhile, if combinations of the projection and the groove are, respectively, provided at the opposite sides of the connector installing portion, a pulling force applied to the connector installing portion can be uniformly restrained by the projections and the grooves at the opposite sides of the connector installing portion. Accordingly, the connector installing portion can be more positively prevented from being upwardly or damaged.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

A locking construction of an electric connection box according to a first embodiment of the present invention is described below with reference to the drawings.

Figure 1A:
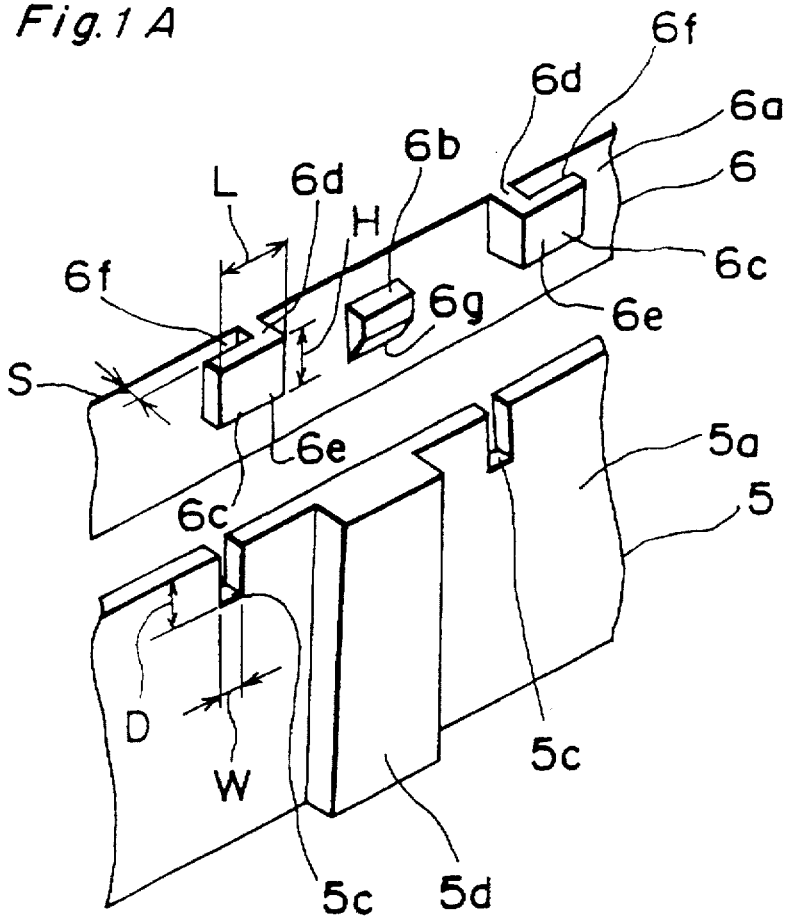
FIG. 1A is a perspective view showing a locking construction of an electric connection box according to a first embodiment of the present invention.
Figure 1B:
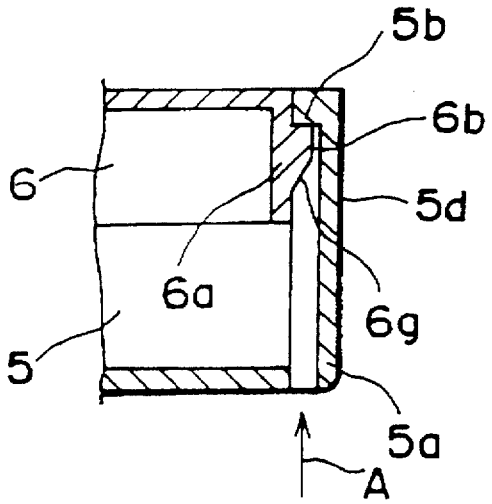
FIG. 1B is a fragmentary sectional view showing a locking claw of the locking construction of FIG. 1A.
Figure 1C:
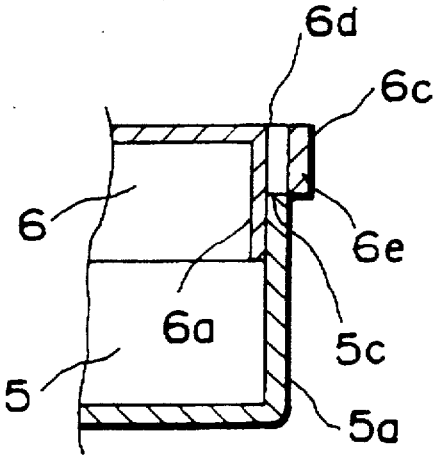
FIG. 1C is a fragmentary sectional view showing a projection of the locking construction of FIG. 1A.
Figure 2A:
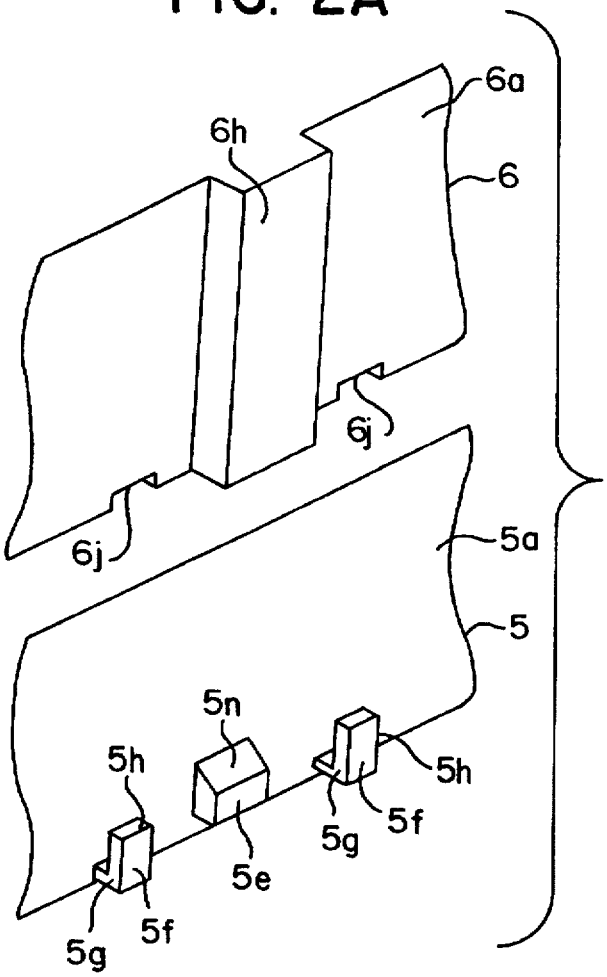
FIG. 2A is a perspective view showing a locking construction of an electric connection box according to a second embodiment of the present invention.
Figure 2B:
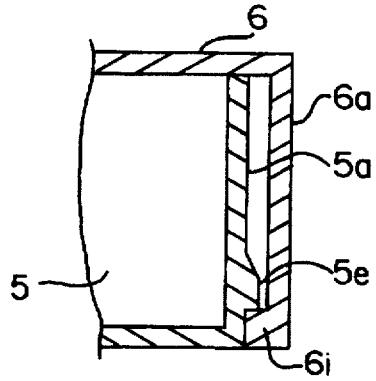
FIG. 2B is a fragmentary sectional view showing a locking claw of the locking construction of FIG. 2A.
Figure 2C:
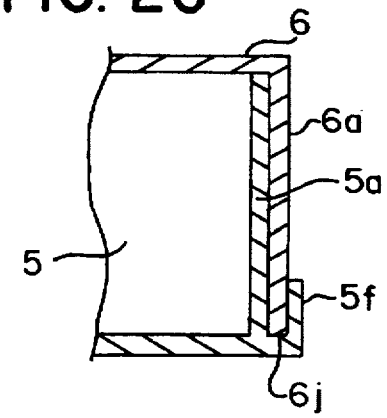
FIG. 2C is a fragmentary sectional view showing a projection of the locking construction of FIG. 2A.
Figure 2D:
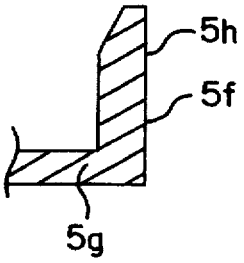
FIG. 2D is an enlarged sectional view of the projection of FIG. 2C.
Figure 6:
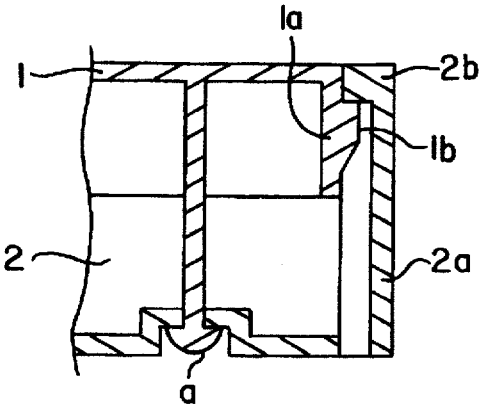
FIG. 6 PRIOR ART
FIG. 6 is a sectional view showing a conventional locking construction of an electric connection box.

As shown in FIG. 1A to 1C, a side wall 6a of an upper casing 6 is fitted into a side wall 5a of a lower casing 5 from above.

An outwardly projecting locking claw 6b is formed on the side wall 6a of the upper casing 6, and a pair of outwardly projecting L-shaped projections 6c are provided on the side wall 6a at opposite sides of and adjacent to the locking claw 6b.

The locking claw 6b has a rectangular upper portion projecting perpendicularly from the side wall 6a and an oblique guide surface 6g formed on its lower portion.

Each of the L-shaped projections 6c comprises a base portion 6d projecting perpendicularly from the side wall 6a and a bent portion 6e bent perpendicularly from a distal end of the base portion 6d. The projection 6c has a height H so as to extend from an upper end of the side wall 6a to a location slightly downwardly of a lower end of the locking claw 6b.

As shown in FIG. 1B in detail, a bulge portion 5d projects outward stepwise from the side wall 5a of the lower casing 5. An engageable portion 5b which engages with the locking claw 6b on the side wall 6a of the upper casing 6 when the upper casing 6 is fitted into the lower casing 5 is formed at an inner side of an upper end of the bulge portion 5d.

A pair of grooves 5c into each of which the base portion 6d of projection 6c of the upper casing 6 is inserted from above are formed on an upper end of the side wall 5a of the lower casing 5. Hereinafter, the grooves 5c, and similar grooves in the remaining embodiments, may also be termed "notches".

A depth D of each groove 5c is almost equal to the height H of each projection 6c, while a width W of each groove 5c is almost equal to that of the base portion 6d of each projection 6c. Meanwhile, an interval S between the side wall 6a and an inner side of the bent portion 6e of each projection 6c is almost equal to the thickness of the side wall 5a of the lower casing 5, while a length L of each projection 6c is several times as large as the width W of the groove 5c.

The bent portion 6e of the projection 6c of the upper casing 6 is directed outward in the first embodiment but may be directed inward.

When the side wall 6a of the upper casing 6 is fitted into the side wall 5a of the lower casing 5 from above in the electric connection box having the construction of the first embodiment, the base portion 6d of the projection 6c of the upper casing 6 is initially inserted into the groove 5c of the lower casing 5.

At the moment of insertion of the base portion 6d into the upper end of the groove 5c, the locking claw 6b of the upper casing 6 does not press the side wall 5a of the lower casing 5 outward. Thus, the base portion 6d can be smoothly inserted into the groove 5c.

Immediately after the projection 6c has been inserted into the groove 5c, the oblique guide surface 6g of the locking claw 6b engages with the engageable portion 5b while pressing the side wall 5a outward gradually such that the upper casing 6 is locked to the lower casing 5.

At the time of this locking, outward deformation of the side wall 5a by the locking claw 6b is restricted by the bent portion 6e of the projection 6c. However, when the locking claw 6b is slightly forcibly depressed into the lower casing 5, the locking claw 6b is brought into engagement with the locking engageable portion 5b.

In a state in which the locking claw 6b is held in engagement with the engageable portion 5b as described above, each of the base portions 6d of the projections 6c engages with each of the grooves 5c formed at opposite sides of the locking portion and the side wall 5a is held in the gap having the intervals between the bent portion 6e and the side wall 6a. As a result, outward deformation of the side wall 5a is restricted.

Therefore, even though a user, etc. try to deflect the side wall 5a of the lower casing 5 outward to disengage the locking claw 6b from the engageable portion 5b such that the upper casing 6 and the lower casing 5 are unlocked from each other, a portion of the side wall 5a of the lower casing 5 adjacent to the engageable portion 5b is held by the bent portion 6f of the projection 6c in the groove 5c and thus, is least likely to be deflect outwardly. Therefore, the locking claw 6b cannot be disengaged from the engageable portion 5b easily.

Hence, the user, etc. will find it difficult to remove the upper casing 6 from the lower casing 5 so as to touch an internal circuit, so that such risk as a short circuit can be prevented in advance. Furthermore, since a welding process is not required, i.e., the upper casing 6 is not welded to the lower casing 5, the electric connection box can be manufactured at a low cost.

On the other hand, in order to remove the upper casing 6 from the lower casing 5 during maintenance of the electric connection casing at a maker or a dealer, a jig is inserted upward into a space between the bulge portion 5d and the side wall 6a in the direction of the arrow A in FIG. 1B to deflect the side wall 6a of the upper casing 6 inward. As a result, the locking claw 6b can be disengaged from the engageable portion 5b.

In the first embodiment, the lower end of the projection 6c is located slightly downwardly of the lower end of the locking claw 6b so as to insert the projection 6c into the groove 5c before the side wall 5a is deformed outward by the locking claw 6b. However, in case amount of outward deformation of the side wall 5a is small owing to not only the oblique guide surface 6g formed at the lower portion of the locking claw 6b but distance between the groove 5c and the engageable portion 5b, the lower end of the projection 6c and that of the locking claw 6b may be set at the same level such that the projection 6c is inserted into the groove 5c at the time of engagement of the locking claw 6b with the engageable portion 5b.

If the lower end of the projection 6c is located above the lower end of the projection 6c and depth of insertion of the projection 6c into the groove 5c is small, the projection 6c may be detached from the groove 5c prior to disengagement of the locking claw 6b from the engageable portion 5b when the locking claw 6b is forcibly pressed inward with the jig. Therefore, it is preferable to locate the lower end of the projection 6c below the lower end of the projection 6c so that the projection 6c is not disengaged from the groove 5c even after the locking claw 6b has been disengaged from the engageable portion 5b.

A locking construction of an electric connection box according to a second embodiment of the present invention is described below with reference to FIGS. 2A to 2D. In the electric connection box according to the first embodiment, the side wall 6a of the upper casing 6 is fitted into the side wall 5a of the lower casing 5. On the other hand, in the locking construction of the electric connection box according to the second embodiment, the side wall 6a of the upper casing 6 is fitted around the side wall 5a of the lower casing 5 from above.

In the second embodiment, a locking claw 5e and a pair of upwardly extending projections 5f are formed on the side wall 5a of the lower casing 5, while an engageable portion 6i is formed at an inner side of a lower end of a bulge portion 6h of the side wall 6a of the upper casing 6. Furthermore, a pair of grooves 6j each of which receives a base portion 5g of each projection 5f of the lower casing 5 from above are formed on the lower end of the side wall 6a.

In the locking construction of the second embodiment, when the side wall 6a of the upper casing 6 is fitted around the side wall 5a of the lower casing 5 from above, the side wall 6a is initially brought into contact with a bent portion 5h of the projection 5f of the lower casing 5 so as to be restricted from being deformed outward and at the same time, is pressed outward by an inclined guide surface 5n of the locking claw 5e. Then, while the side wall 6a is being forcibly pressed by the locking claw 5e, the upper casing 6 is fitted around the lower casing 5 such that the locking claw 5e is brought into engagement with the engageable portion 6i formed at the lower end of the upper casing 6. At this time, the base portion 5g of each projection 5f is inserted into each groove 6j formed at the lower end of the side wall 6a.

In the locking construction described above, even though the user, etc. try to deflect the side wall 6a of the upper casing 6 outward to disengage the locking claw 5e from the engageable portion 6i such that the upper casing 6 is unlocked from the lower casing 5, a portion of the lower end of the side wall 6a of the upper casing 6 adjacent to the engageable portion 6i is held by the projections 5f in the grooves 6j so as to be least likely to be deflected outwardly. Therefore, the locking claw 5e cannot be easily disengaged from the locking engageable portion 6i.

Also, in the second embodiment as in the first embodiment, the projection 5f may be formed by bending it laterally. That is, the projection 5f may be formed by orienting the bent portion 5h from a distal end of the base portion 5g in a direction toward the locking claw 5e or in the opposite direction.

In both the first and second embodiments, the projections and the grooves are formed at the opposite sides of the locking portion, but may also be formed at only one side of the locking portion. It is, however, preferable that the upper and lower casings can be locked to each other firmly if the projections and the engagement grooves are provided at the opposite sides of the locking portion.

Figure 3A:
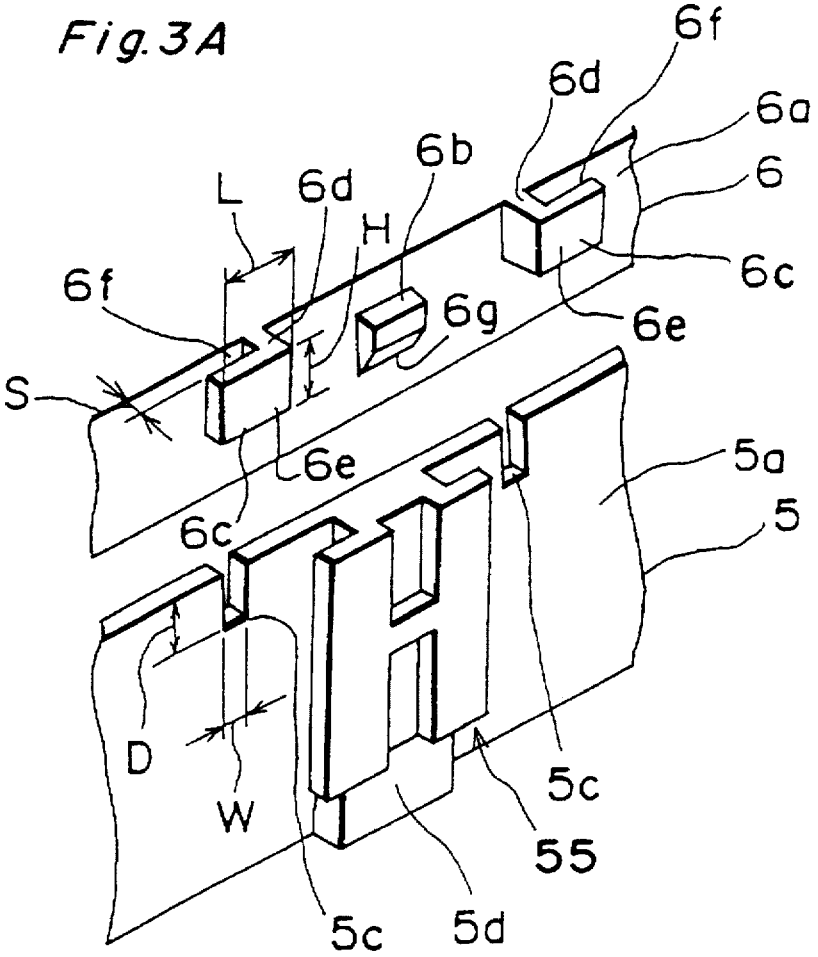
FIG. 3A is a perspective view showing a locking construction of an electric connection box according to a third embodiment of the present invention.
Figure 3B:
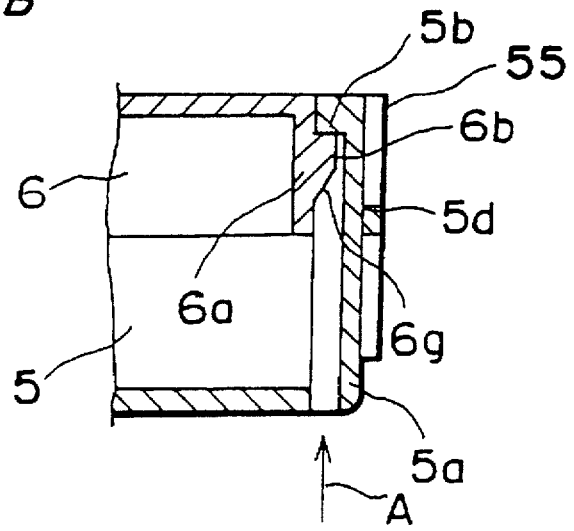
FIG. 3B is a fragmentary sectional view showing a locking claw of the locking construction of FIG. 3A.
Figure 7A:
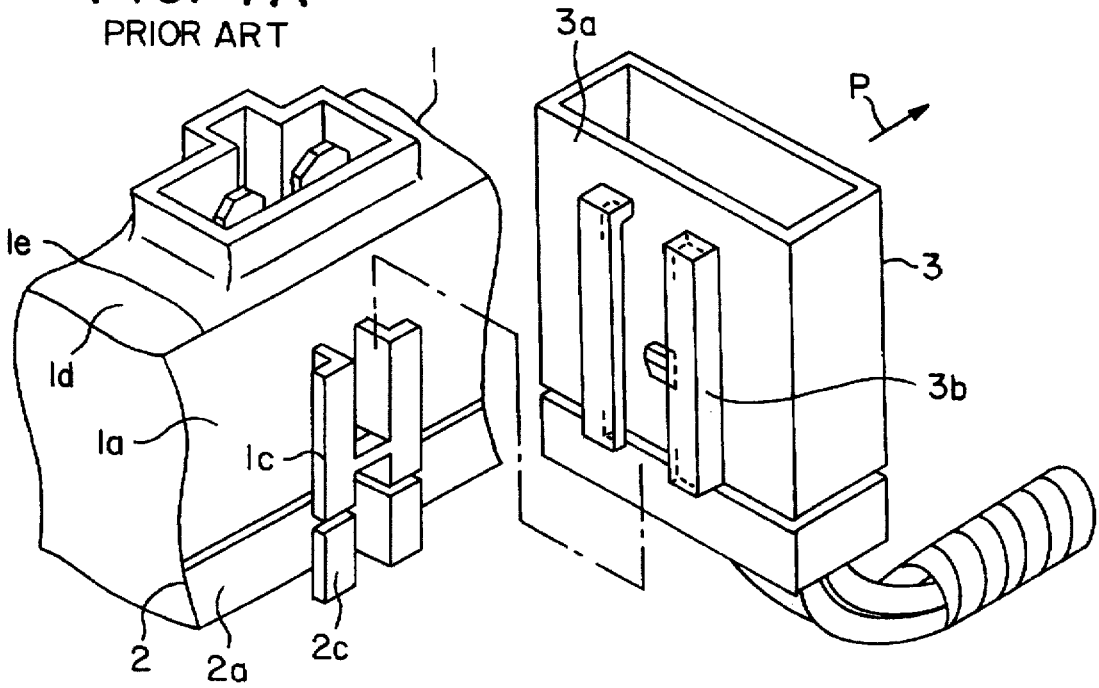
FIG. 7A PRIOR ART
FIG. 7A is a perspective view showing a connector installing construction of a conventional electric connection box.
Figure 7B:
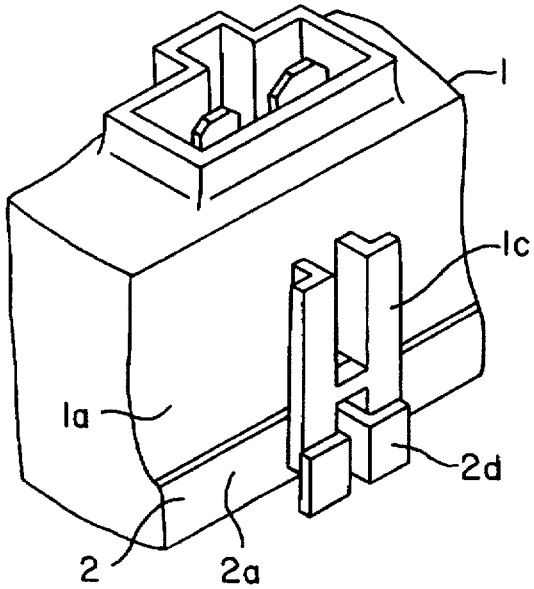
FIG. 7B PRIOR ART
FIG. 7B is a perspective view showing a connector installing construction of another conventional electric connection box.

A locking construction of an electric connection box according to a third embodiment of the present invention is described below with reference to FIGS. 3A and 3B. The third embodiment is characterized in that a connector installing portion is provided on an outer surface of the electric connection box having the locking-construction similar to that of the first embodiment. In the locking construction according to the third embodiment, a connector installing portion 55 integral with the bulge portion 5d of the lower casing 5 is formed on its outer surface and the engageable portion 5b is formed on the inner surface of the bulge portion 5d. An engageable portion 3b formed on an outer wall 3a of a connector 3 shown in FIG. 7A is brought into engagement with the connector installing portion 5f from above.

A pair of the grooves 5c are formed at the opposite sides of the connector installing portion 55. A pair of the projections 6c of the upper casing 6 are inserted into the grooves 5c, respectively so as to be brought into engagement with the grooves 5c. Engagement of the projections 6c with the grooves 5c secures the lower casing 5 to the upper casing 6 positively so as to prevent the lower casing 5 from being moved upward even though the connector 3 installed on the connector installing portion 5f is pulled by an electric wire.

In the locking construction of the electric connection box according to each of the first, second, and third embodiments, the L-shaped projection of one of the upper and lower casings positioned inside the other of the upper and lower casings is inserted into the groove of the other of the upper and lower casings so as to grip the side wall of the other of the upper and lower casings between the bent portion of the projection and the side wall of the one of the upper and lower casings. Thus, the upper end of the side wall of the other of the upper and lower casings is held by the projection of the one of the upper and lower casings so as to be restricted from being deflected outward. Therefore, the locking claw cannot be easily unlocked from the engageable portion.

In the locking construction according to each of the first, second, and third embodiment, the user, etc. cannot disengage the locking claw from the engageable portion easily even though the user, etc. press outwardly the side wall positioned outside the locking portion for the purpose of disengaging the locking claw from the engageable portion. Therefore, the user, etc. cannot touch an internal circuit freely, thereby preventing such risks as a short circuit in the internal circuit.

Further, a welding process is not required, i.e., the upper casing is not welded to the lower casing. Hence, the electric connection box can be manufactured at a low cost.

Since combinations of the projection and the groove are provided at the opposite sides of the locking portion, deformation of the side wall is uniformly restricted at the opposite sides of the locking portion.

Furthermore, if the bent portions of the projections are directed laterally, restrictive range of deformation of the side wall can be increased.

Therefore, if the connector installing portion is provided between the combinations of projection and the groove, the casing is not readily deformed and can be prevented from being moved upwardly even if a pulling force is applied to the connector installed at the connector installing portion.

A locking construction of an electric connection box according to a fourth embodiment of the present invention is described below with reference to FIG. 4. In the locking construction of the electric connection box according to the fourth embodiment, a side wall 16*a* of an upper casing 16 is fitted into a side wall 15*a* of a lower casing 15 from above.

A connector installing portion 15*b* having opposite sectionally L-shaped portions integral with the side wall 15*a* is projected from an outer surface of the side wall 15*a* of the lower casing 15. The engageable portion 3*b* on the outer wall 3*a* of the connector 3 shown in FIG. 7A is brought into engagement with the connector installing portion 15*b* from above.

An upper end surface 15*j* of the side wall 15*a* is recessed to form a pair of grooves 15*c* at opposite sides of the connector installing portion 15*b*. A pair of Projections 16*b* are formed on an outer surface of the side wall 16*a* of the upper casing 16 so as to be, respectively, inserted into the grooves 15*c*.

Each of the projections 16*b* of the upper casing 16 comprises a connection portion 16*e* integral with an upper wall 16*g* of the upper casing 16, a base portion 16*c* projecting downward from one end of the connection portion 16*e* and a bent portion 16*d* projecting downward from an outer side of the connection portion 16*e*. In other words, the connection portion 16*e* extends over an upper surface of an L-shaped portion formed by the base portion 16*c* and the bent portion 16*d*.

The base portion 6*c* is disposed at one end of the projection 16*b* adjacent to the connector installing portion 15*b*, while the bent portion 16*d* extends from the base portion 16*c* in a direction away from the connector installing portion 15*b*.

Each of the grooves 15*c* of the lower casing 15 is of a stepped shape in which a deep groove portion 15*d* for receiving the base portion 16*c* and a shallow groove portion 15*f* for receiving the connection portion 16*e* are formed continuously. The deep groove portion 15*d* is disposed at one side of the groove 15*c* adjacent to the connector installing portion 15*b*.

A depth D1 of the deep groove portion 15*d* is substantially equal to a sum of a thickness of the connection portion 16*e* of each projection 16*b* and a height of the base portion 16*c* and a width W1 of the deep groove portion 15*d* is substantially equal to that of the base portion 16*c*. A depth D2 of the shallow groove portion 15*f* is equal to a thickness of the connection portion 16*e* and a width W2 of the groove 15*c* is equal to a length L of the bent portion 16*d*.

A projecting amount D3 of the base portion 16*c* of each projection 16*b* is substantially equal to a thickness of the side wall 15*a* of the lower casing 15 and the length L of the bent portion 16*d* is several times as large as the width W1 of the deep groove portion 15*d*.

In the electric connection box according to the fourth embodiment including the locking portions comprising the grooves 15*c* and the projections 16*b*, the side wall 16*a* of the upper casing 16 is fitted into the side wall 15*a* of the lower casing 15 from above. As a result, the upper casing 16 engages with the lower casing 15 as shown in FIGS. 5A, 5B, and 5C.

Figure 5A:
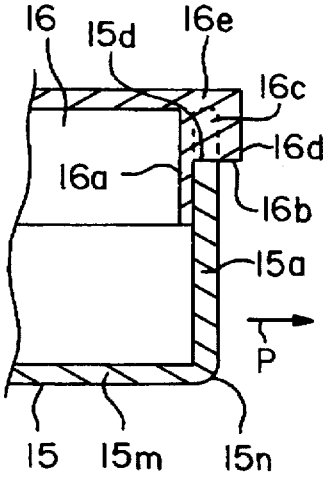
FIGS. 5A, 5B, and 5C are sectional views showing respective portions of the locking construction of FIG. 4 in a state in which an upper casing and a lower casing have been assembled with each other.

FIG. 5A is a sectional view of the deep groove portion 15*d* of the groove 15*c*, in which the base portion 16*c* of the projection 16*b* of the upper casing 16 is inserted into the deep groove portion 15*d*.

Figure 5B:
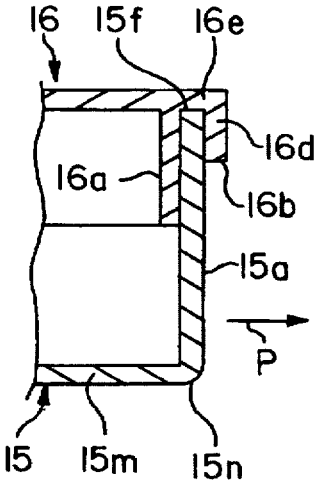

FIG. 5B is a sectional view of the shallow groove portion 15*f* of the groove 15*c*, in which the upper casing 16 and the lower casing 15 have been assembled by engagedly inserting the connection portion 16*e* of the projection 16*b* of the upper casing 16 is inserted into the shallow groove portion 15*f*.

Figure 5C:
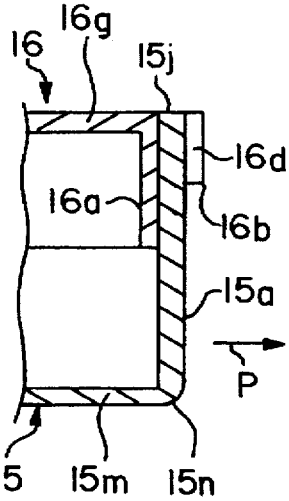

FIG. 5C is a sectional view, a portion of the electric connection box at which the groove 15*c* is not formed and the upper casing 16 and the lower casing 15 are assembled with each other such that the upper wall 16*g* of the upper casing 16 is flush with an upper end surface 15*j* of the side wall 15*a* of the lower casing 15*a*.

When the projections 16*b* are brought into engagement with the grooves 15*c*, respectively as described above, the bent portion 16*d* of each projection 16*b* of the upper casing 16 is brought into contact with the outer surface of the side wall 15*a* of the lower casing 15. As a result, the side wall 15*a* of the lower casing 15 is gripped between the bent portion 16*d* and the side wall 16*a* of the upper casing 16.

When the pulling force P is applied to the connector 3 (FIG. 7A) installed on the connector installing portion 15*b* of the lower casing 15 by a wiring harness or the like connected with the connector 3, the projection 16*d* of the upper casing 16 restrains the side wall 15*a* of the lower casing 15 from being deformed. Therefore, the side wall 15*a* is not pulled outwardly so as to be moved upward. Thus, there is no possibility that a corner 15*n* between the side wall 15*a* and a bottom wall 15*m* is damaged.

In the projection 16*b* of the upper casing 16 serving as a reinforcing portion against the outward pulling force, the upper end of the base portion 16*c* and that of the bent portion 16*d* are coupled with the side wall 16*a* by the connection portion 16*e* so as to reinforce the base portion 16*c* and the bent portion 16*d*. Therefore, strength of the projection 16*b* can be raised without increasing its size or its thickness.

Since the base portions 16*c* and the bent portions 16*d* are reinforced by the connection portion 16*e*, the base portion 16*c* and the bent portion 16*d* are least likely to be fractured, cracked or clipped at the time of their molding and assembly.

In the locking construction according to the fourth embodiment, the bent portion 16*d* is oriented outward in the direction away from the connector installing portion 15*b* but may also be oriented inward toward the connector installing portion 15*b*.

Figure 4A:
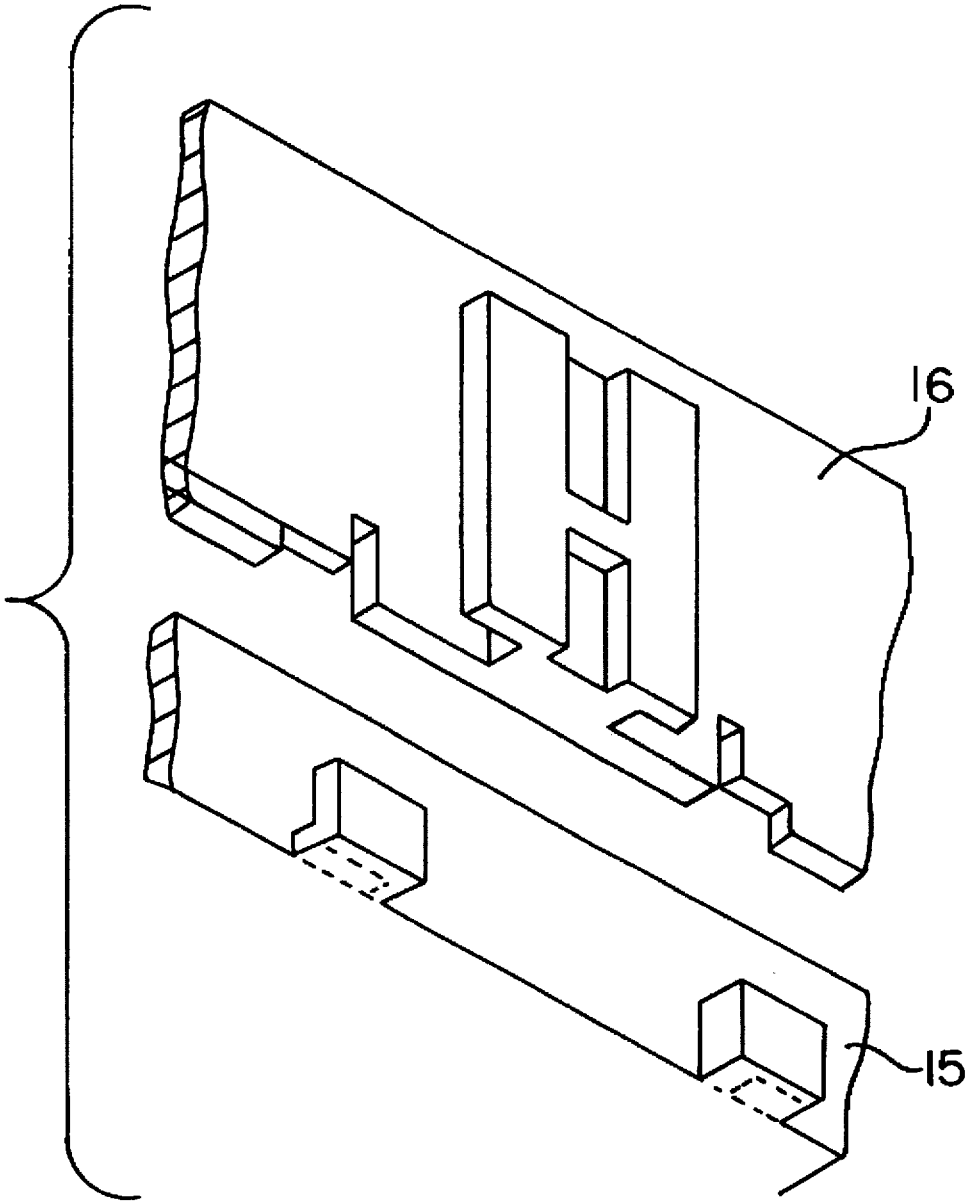
FIG. 4A is an exploded perspective view showing a variation of the fourth embodiment.
Figure 4:
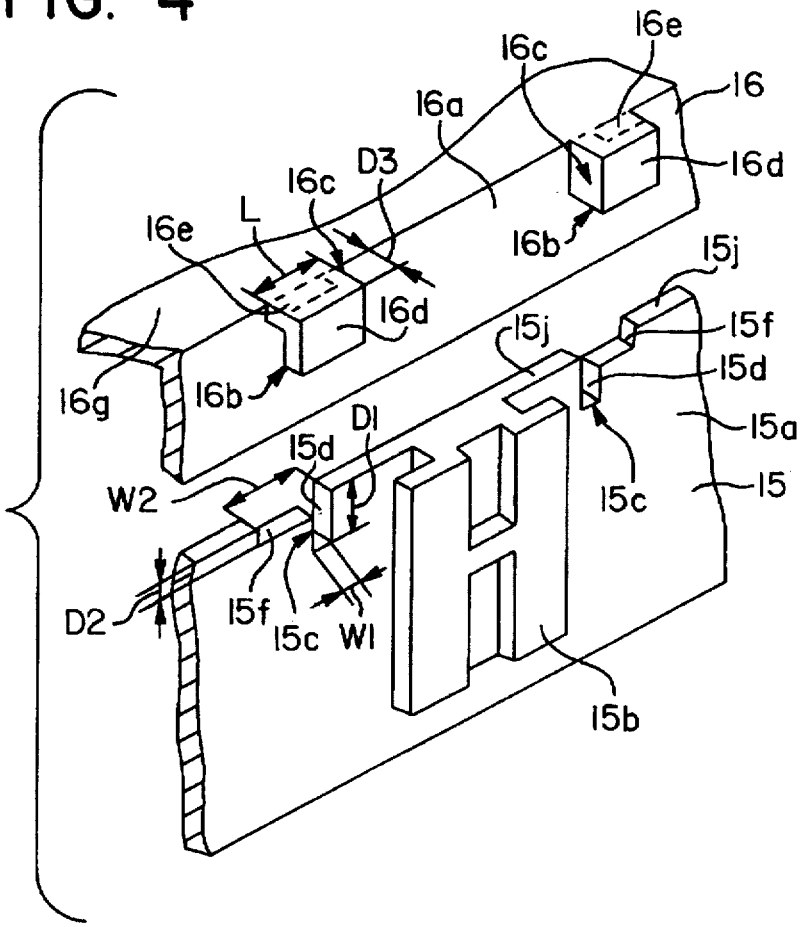
FIG. 4 is an exploded perspective view showing a locking construction of an electric connection box according to a fourth embodiment of the present invention.

Instead of forming the projection 16*b* on the upper casing 16 and the groove 15*c* on the lower casing 15, the groove 15*c* may be formed on the upper casing 16 and the projection 16*b* may be formed on the lower casing 15 (As shown in FIG. 4A). Namely, the groove is formed on one casing provided with the connector installing portion and the projection engageable with the groove is formed on the other casing.

In the locking construction according to the fourth embodiment, the combinations of the projection and the groove are preferably provided at the opposite sides of the connector installing portion but may also be formed at only one side of the connector installing portion.

In the locking construction of the electric connection box of the fourth embodiment, even if the pulling force is applied to the connector attached to the connector installing portion, the side wall having the connector installing portion is brought into contact with the bent portions of the projections on the other side wall and thus, is not pulled so as to be moved upwardly. Therefore, there is no risk that the side wall having the connector installing portion is deformed or damaged, thereby resulting in improvement of quality of the electric connection box.

Meanwhile, since the reinforcing connection portion extending over the base portion and the bent portion is formed at an end of the projection, strength of the projection is raised without increasing its size or its thickness. Thus, the projection is least likely to be fractured, cracked or clipped, thereby resulting in further improvement of the electric connection box.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A locking construction of an electric connection box having an upper casing and a lower casing, one of the upper and lower casing telescoping into the other, said locking construction comprising:

a locking claw provided on an outer surface of a first side wall of said one of the upper and lower casings;

an engageable portion which is provided on an inner surface of a second side wall of the remaining one of the upper and lower casings, such that the locking claw is brought into engagement with the engageable portion as the first side wall travels in a first axial direction to telescope into the second side wall, and locks the first side wall with respect to the second side wall to prevent the upper and lower cases from being separated from one another in a direction opposite from said first axial direction;

an L-shaped projection provided on the outer surface of the first side wall in the vicinity of the locking claw; said L-shaped projection including a base portion extending from the first side wall and a bent portion extending from the base portion; and a notch formed in an edge face of the second side wall such that the base portion of the L-shaped projection is inserted into the notch as the the first side wall telescopes into the second side wall;

wherein when the base portion of the projection has been inserted into the notch, the second side wall is gripped between the bent portion of the projection and the first side wall, preventing the outward deflection of the second side wall from the first side wall in a direction other than said first axial direction.

2. A locking construction as claimed in claim 1, wherein a pair of the projections are, respectively, provided at opposite sides of the locking claw and a pair of the notches are, respectively, provided at opposite sides of the engageable portion.

3. A locking construction as claimed in claim 2, further comprising:

a connector installing portion for mounting a connector thereon, provided on an outer surface of the second side wall opposite the location of the engageable portion on the inner surface of the second side wall.

4. A locking construction as claimed in claim 1, wherein the bent portion of the projection is oriented in a direction towards or away from the locking claw.

5. A locking construction of an electric connection box including an upper casing and a lower casing, comprising:

a projection integrally provided on an outer surface of a first side wall of one of the upper and lower casings and includes a connection portion extending from the first side wall, a base portion extending from one end of the connection portion one of upwardly and downwardly and a bent portion extending from an outer side of the connection portion one of upwardly and downwardly such that an L-shaped portion is formed by the base portion and the bent portion; and a groove formed on an open end of a second side wall of the other of the upper and lower casings and includes a deep groove portion and a shallow groove portion formed in a stepped shape continuously such that the first side wall is fitted into the second side wall;

wherein the base portion and the connection portion of the projections are, respectively, inserted into the deep groove portion and the shallow groove portion of the groove such that the second side wall is gripped between the bent portion of the projection and the first side wall.

6. A locking construction as claimed in claim 5, further comprising:

a connector installing portion for mounting a connector thereon, which is provided on an outer surface of the second side wall;

wherein a pair of the grooves are, respectively, provided at opposite sides of and in the vicinity of the connector installing portion and a pair of the projections are provided on the first side wall so as to be inserted into the grooves, respectively.

* * * * *